US007179159B2

(12) United States Patent
Bonner et al.

(10) Patent No.: US 7,179,159 B2
(45) Date of Patent: Feb. 20, 2007

(54) MATERIALS FOR CHEMICAL MECHANICAL POLISHING

(75) Inventors: Benjamin A. Bonner, San Jose, CA (US); Peter McReynolds, San Mateo, CA (US); Gregory E. Menk, Pleasanton, CA (US); Anand N. Iyer, Santa Clara, CA (US); Gopalakrishna B. Prabhu, San Jose, CA (US); Erik S. Rondum, San Ramon, CA (US); Robert L. Jackson, San Jose, CA (US); Garlen Leung, San Jose, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 11/119,682

(22) Filed: May 2, 2005

(65) Prior Publication Data

US 2006/0246831 A1 Nov. 2, 2006

(51) Int. Cl.
*B24D 11/00* (2006.01)

(52) U.S. Cl. ..... 451/527; 451/530; 451/533

(58) Field of Classification Search ..... 451/533, 451/527–530, 537–539, 296
See application file for complete search history.

(56) References Cited

U.S. PATENT DOCUMENTS 5,152,917 A 10/1992 Pieper et al.
5,335,453 A 8/1994 Baldy et al.
5,342,419 A 8/1994 Hibbard
5,368,619 A 11/1994 Culler
5,378,251 A 1/1995 Culler et al.
5,453,312 A 9/1995 Haas et al.
5,692,947 A 12/1997 Talieh et al.
5,692,950 A 12/1997 Rutherford et al.
5,810,964 A 9/1998 Shiraishi
5,938,504 A 8/1999 Talieh
6,089,966 A * 7/2000 Arai et al. ..... 451/533
6,121,143 A 9/2000 Messner et al.
6,149,506 A 11/2000 Duescher
6,179,709 B1 1/2001 Redeker et al.
6,244,935 B1 6/2001 Birang et al.
6,312,319 B1 11/2001 Donohue et al.
6,354,929 B1 3/2002 Adefris et al.
6,379,231 B1 4/2002 Birang et al.
6,413,873 B1 7/2002 Li et al.
6,419,533 B2 7/2002 Lecours
6,419,559 B1 7/2002 Gurusamy et al.
6,478,914 B1 11/2002 Bartlett et al.

(Continued)

*Primary Examiner*—Dung Van Nguyen
(74) *Attorney, Agent, or Firm*—Patterson and Sheridan

(57) ABSTRACT

A polishing article and method for manufacturing a polishing article for use in a chemical mechanical polishing process is disclosed. The polishing article has a plurality of polishing material tiles separated by grooves formed in or through a polishing material and may be adhesively bound to a base film. The polishing article may include various polygonal tiles and oval shapes formed in the polishing material which allow enhanced slurry retention and ease in rolling from a polishing material supply roll and onto a take-up roll in a web type platen assembly. The polishing article may also include an upper carrier film adapted to minimize delaminating stress placed in an area of the polishing article that is not adapted for polishing. A method and apparatus for manufacturing the various embodiments of the polishing article and a replacement supply roll are also disclosed.

17 Claims, 5 Drawing Sheets

U.S. PATENT DOCUMENTS 6,482,072 B1 11/2002 Gurusamy et al.
6,491,570 B1 12/2002 Sommer et al.
6,503,131 B1 1/2003 Franklin et al.
6,520,841 B2 2/2003 Birang et al.
6,540,595 B1 4/2003 Birang
6,585,563 B1 7/2003 Redeker et al.
6,592,439 B1 7/2003 Li et al.
6,612,917 B2 9/2003 Bruxvoort
6,620,032 B2 * 9/2003 Chopra ..... 451/41
6,632,129 B2 10/2003 Goetz
6,676,483 B1 1/2004 Roberts et al.
6,676,718 B2 1/2004 Luo et al.
6,729,944 B2 5/2004 Birang et al.
6,746,311 B1 * 6/2004 Kessel ..... 451/41
6,783,436 B1 8/2004 Muldowney
6,796,880 B2 9/2004 Redeker et al.
6,843,711 B1 1/2005 Muldowney
6,848,986 B2 2/2005 Kendall et al.
6,899,602 B2 * 5/2005 Fawcett et al. ..... 451/57
2002/0019199 A1 2/2002 Goers
2002/0106980 A1 8/2002 Bruxvoort
2002/0111120 A1 8/2002 Goetz
2003/0022598 A1 1/2003 Muilenburg et al.
2003/0022604 A1 1/2003 Annen
2003/0022611 A1 1/2003 Bartlett et al.
2003/0064663 A1 4/2003 Muilenburg et al.
2003/0113509 A1 6/2003 Lugg
2003/0143938 A1 7/2003 Branunschweig et al.
2003/0150169 A1 8/2003 Annen
2003/0181144 A1 9/2003 Mujumdar et al.
2003/0194961 A1 10/2003 Kendall et al.
2003/0199235 A1 10/2003 Kollodge et al.
2003/0207659 A1 11/2003 Annen et al.
2004/0072506 A1 4/2004 Goetz
2004/0082288 A1 4/2004 Tietz et al.
2004/0137826 A1 7/2004 Gagliardi et al.
2004/0137831 A1 7/2004 Kollodge et al.
2004/0153197 A1 8/2004 Palmgren
2005/0032462 A1 2/2005 Gagliardi et al.
2005/0097824 A1 5/2005 Braunschweig et al.
2005/0197050 A1 * 9/2005 Prasad et al. ..... 451/41
2005/0197273 A1 9/2005 Savu et al.

* cited by examiner

MATERIALS FOR CHEMICAL MECHANICAL POLISHING

BACKGROUND OF THE INVENTION

1. Field of the Invention

Embodiments of the invention generally relate to an apparatus and method for chemical mechanical polishing of substrates or wafers, more particularly, to a polishing article and a method of manufacture of a polishing article for chemical mechanical polishing.

2. Description of the Related Art

In the fabrication of integrated circuits and other electronic devices on substrates, multiple layers of conductive, semiconductive, and dielectric materials are deposited on or removed from a feature side of a substrate. The sequential deposition and removal of these materials on the substrate may cause the feature side to become non-planar and require a planarization process, generally referred to as polishing, where previously deposited material is removed from the feature side of a substrate to form a generally even, planar or level surface. The process is useful in removing undesired surface topography and surface defects, such as rough surfaces, agglomerated materials, crystal lattice damage and scratches. The polishing process is also useful in forming features on a substrate by removing excess deposited material used to fill the features and to provide an even or level surface for subsequent deposition and processing One polishing process is known as Chemical Mechanical Polishing (CMP) where a substrate is placed in a substrate carrier assembly and controllably urged against a polishing media mounted to a moving platen assembly. The carrier assembly provides rotational movement relative to the moving platen and material removal is accomplished by chemical activity, mechanical abrasion, or a combination of chemical activity and mechanical abrasion between the feature side of the substrate and the polishing media.

CMP has advanced over the years and is essentially limited to two types of systems that differ in the type polishing media mounted to the platen assembly that contacts the feature side of the substrate. One type of polishing media is a circular stick-down pad, known in the art as conventional CMP polishing material or a standard pad that is bound to the platen by adhesives and uses a chemical composition containing small abrasive particles that is flowed onto the processing surface of the pad to provide mechanical abrasion and polish the substrate. Standard pads typically have a roughened, durable surface and are relatively thicker and less pliable than other types of polishing media. Although this thickness and relative hardness typically results in a longer usable life of the pad, the pad is eventually spent. Replacement is time consuming since the pad must be peeled off the platen, the platen must be cleaned before a new pad is installed, and requalification of the tool is required.

Another type of system is known in the art as a web system or roll format. This system typically uses a relatively pliable, web of material on the rotating platen assembly. The web type material is typically a continuous roll moved from a feed roll and advanced across the platen assembly in a rectangular section to a take-up roll. The rectangular section is adapted to contact the feature side of the substrate and the web material effects mechanical abrasion to remove material. After a number of substrates have been processed, a portion of the polishing surface is spent, and the web may be advanced in small increments at predetermined intervals, e.g., one inch or less, to provide the introduction of a new portion of polishing surface to the substrate. Once this advancement depletes the supply roll, a new supply roll is installed in a manner that takes considerably less time than circular pad replacement.

Therefore, there is a need in the art to combine the durability of a standard pad with the ease of replacement offered by a roll format, and a polishing article that is capable of providing process uniformity in a polishing surface typical of the standard pad.

SUMMARY OF THE INVENTION

In one embodiment, a processing article for removing material from a substrate or semiconductor wafer comprises a base film and a plurality of polishing tiles made from a polishing material positioned on the base film and configured to define a plurality of grooves therebetween. The plurality of grooves are adapted to enable fluid flow therein and facilitate delivery and take up in a roll format. The tiles may be polygons, for example, the tiles may be substantially rectangular and adhered to the base film in a cross machine direction that is substantially orthogonal to the machine-direction edge of the base film, e.g., 0° relative to the cross-machine direction. In another embodiment, the tiles may be substantial parallelograms adhered to the base film in an orientation between about 0° to about 50° relative to the cross-machine direction. In another embodiment, the polygonal tiles disposed on the base film may have an upper carrier film adhered in narrow strips to parallel machine-direction edges of the polishing article to counteract delaminating forces.

In another embodiment, a method of manufacturing a polishing article for removing material from a substrate or semiconductor wafer comprises the steps of applying an adhesive to a base film, locating a plurality of polishing material tiles adjacent the base film, and joining the polishing material tiles to the base film to form a polishing article.

In another embodiment, a replacement supply roll for a web platen assembly for removing material from a substrate is disclosed comprising a roll of polishing material, the polishing material having a plurality of polishing material tiles, a base film, and an adhesive layer therebetween to support the upper layer on the base film.

In another embodiment, a processing article for removing material from a substrate or semiconductor wafer comprises a plurality of tiles made of a polishing material which define a plurality of grooves therebetween. Each of the plurality of grooves are of a depth that is less than the thickness of the polishing material to define a plurality of tiles that are connected by a portion of the remaining polishing material to form a polishing article for use in a roll format.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
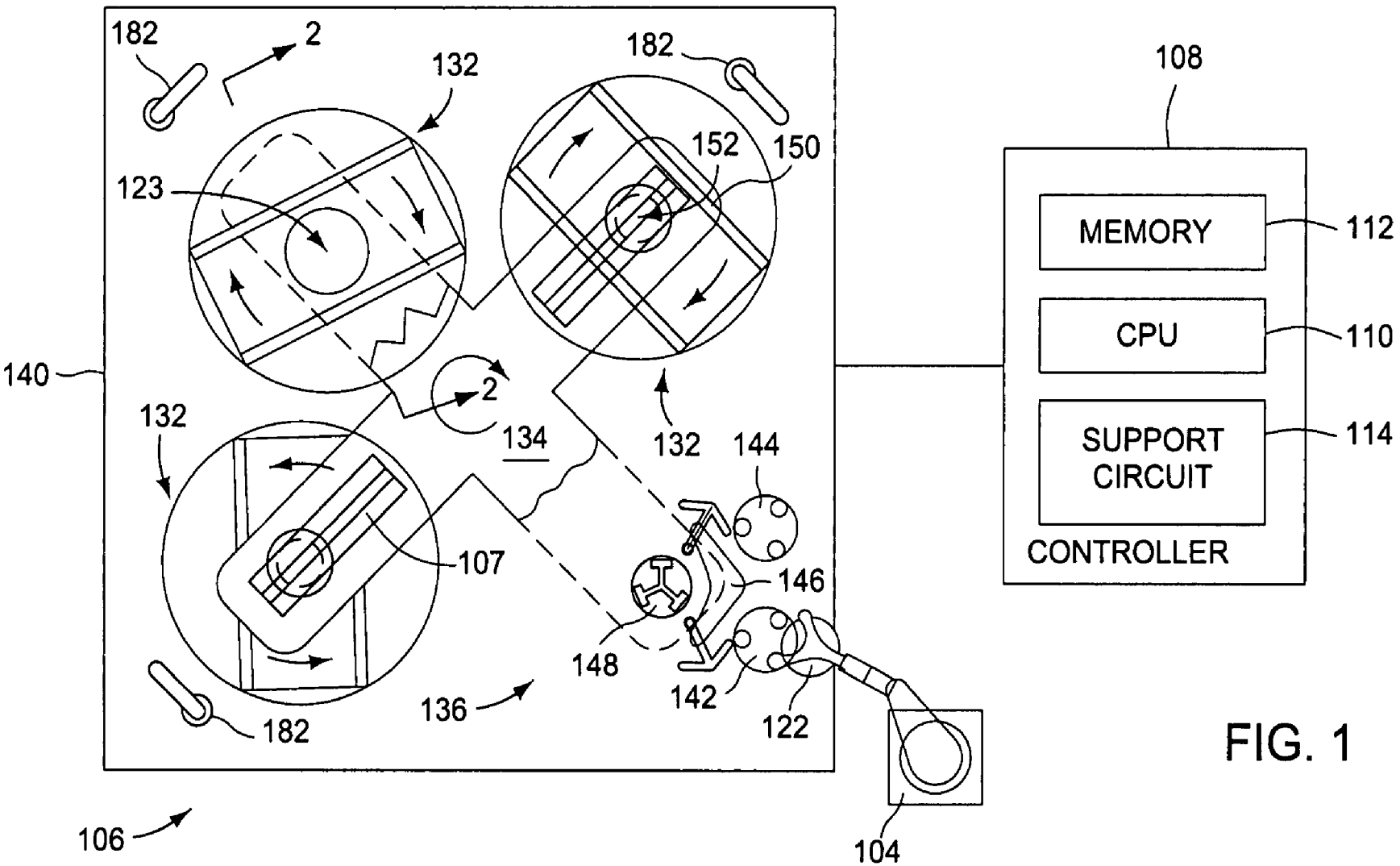
FIG. 1 is a plan view of an exemplary chemical mechanical polishing module.

FIG. 1 depicts a plan view of a polishing module 106 which is a portion of a REFLEXION® Chemical Mechanical Polisher, manufactured by Applied Materials, Inc., located in Santa Clara, Calif. Embodiments described herein may be used on this polishing system. However, one skilled in the art may advantageously adapt embodiments as taught and described herein to be employed on other chemical mechanical polishers that utilize polishing material, and particularly polishing material in a roll format.

The module 106 generally comprises a loading robot 104, a controller 108, a transfer station 136, a plurality of processing or polishing stations, such as platen assemblies 132, a base 140 and a carousel 134 that supports a plurality of polishing or carrier heads 152. Generally, the loading robot 104 is disposed proximate the module 106 and a factory interface 102 (not shown) to facilitate the transfer of substrates 122 therebetween.

The transfer station 136 generally includes a transfer robot 146, an input buffer 142, an output buffer 144 and a load cup assembly 148. The input buffer station 142 receives a substrate 122 from the loading robot 104. The transfer robot 146 moves the substrate 122 from the input buffer station 142 and to the load cup assembly 148 where it may be transferred to the carrier head 152. An example of a transfer station that may be used to advantage is described in reference to the FIGS. 2–6 in U.S. Pat. No. 6,156,124, issued Dec. 5, 2000, entitled "Wafer Transfer Station for a Chemical Mechanical Polisher", which is incorporated herein by reference.

To facilitate control of the module 106 as described above, the controller 108 comprises a central processing unit (CPU) 110, support circuits 114 and memory 112. The CPU 110 may be one of any form of computer processor that can be used in an industrial setting for controlling various polishers, drives, robots and sub-processors. The memory 112 is coupled to the CPU 110. The memory 112, or computer-readable medium, may be one or more of readily available memory such as random access memory (RAM), read only memory (ROM), floppy disk, hard disk, or any other form of digital storage, local or remote. The support circuits 114 are coupled to the CPU 110 for supporting the processor in a conventional manner. These circuits include cache, power supplies, clock circuits, input/output circuitry, subsystems, and the like.

Generally, the carousel 134 has a plurality of arms 150 that each support one of the carrier heads 152. Two of the arms 150 depicted in FIG. 1 are shown in phantom such that the transfer station and a planarizing or polishing article 123 disposed on one of the platen assemblies 132 may be seen. The carousel 134 is indexable such that the carrier heads 152 may be moved between the platen assemblies 132 and the transfer station 136.

Typically, a chemical mechanical polishing process is performed at each platen assembly 132 by moving the substrate 122 retained in the carrier head 152 relative to the polishing article 123 supported on the platen assembly 132. The polishing article 123 may have a smooth surface, a textured surface, a surface containing abrasives or a combination thereof. Additionally, the polishing article 123 may be advanced across or releasably fixed to the polishing surface. Typically, the polishing article 123 is releasably fixed by adhesives, vacuum, mechanical clamps or by other holding methods to the platen assembly 132.

Embodiments of the polishing article 123 may comprise a conventional pad material which is generally a polymer that is free of added abrasive particles, for example, polymeric materials currently used by pad manufacturers such as Rodel Inc., of Newark, Del. Embodiments of the polishing material used in the polishing article 123 may utilize a slurry containing abrasive particles delivered to the pad surface to aid in polishing the substrate 122.

Figure 2:
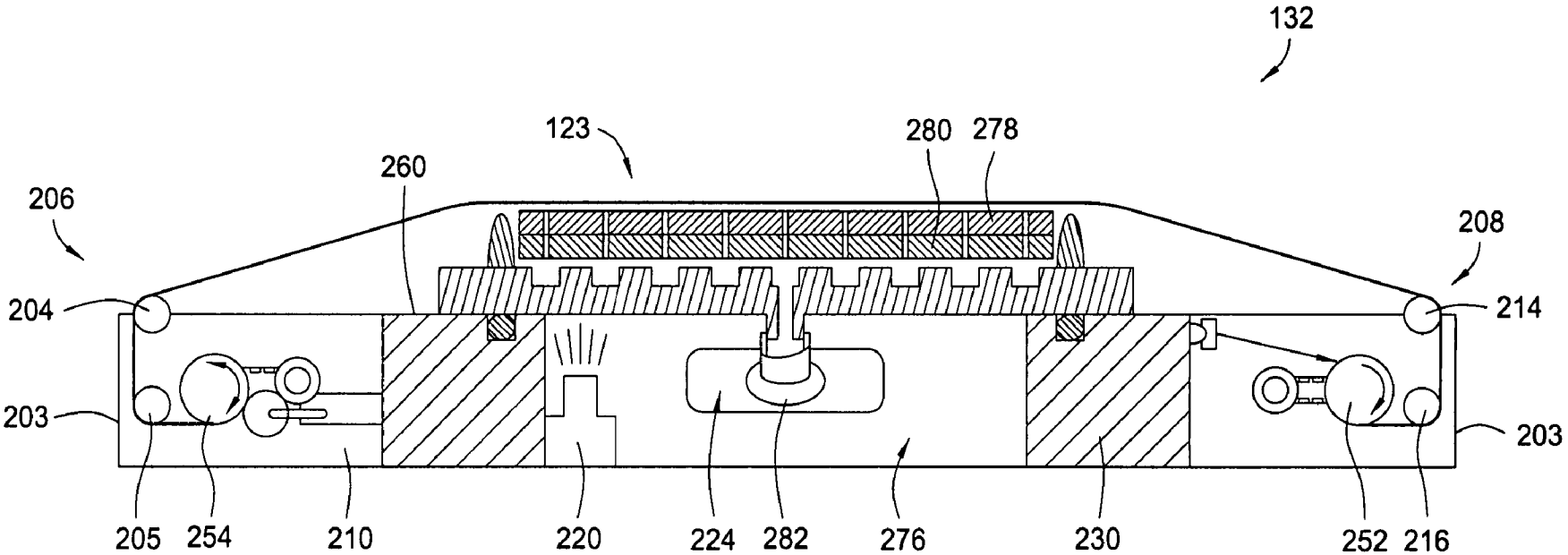
FIG. 2 is a sectional view of an exemplary processing station.

FIG. 2 depicts a side view of the platen assembly 132 and an exemplary supply assembly 206 and a take up assembly 208, illustrating the position of the polishing article 123 across a platen 230. Generally, the supply assembly 206 includes the supply roll 254, an upper guide member 204 and a lower guide member 205 that are disposed between the side walls 218. The supply roll 254 generally contains an unused portion of polishing article 123 and is configured so that it may easily be replaced with another supply roll 254 containing a new polishing article 123 once the polishing article 123 disposed on the supply roll 254 has been consumed by the polishing or planarizing process. One embodiment of a replaceable supply roll is disclosed in U.S. Pat. No. 6,244,935, issued Jun. 12, 2001, entitled "Apparatus and Methods for Chemical Mechanical Polishing with an Advanceable Polishing Sheet", incorporated herein by reference in its entirety not inconsistent with the present invention.

The lower guide member 205 is positioned to lead the polishing article 123 from the supply roll 254 to the upper guide member 204. The upper guide member 204 is disposed between the sidewalls 218 such that the polishing article 123 leading off the upper guide member 204 is disposed substantially coplanar, i.e., lies immediately adjacent and parallel to the top surface 260 of the platen 230.

Generally, the take-up assembly 208 includes the take-up roll 252, an upper guide member 214 and a lower guide member 216 that are all disposed between the sidewalls 218. The take-up roll 252 generally contains a used portion of polishing article 123 and is configured so that it may easily be replaced with an empty take-up roll once take-up roll 252 is filled with used polishing article 123. The upper guide member 214 is positioned to lead the polishing article 123 from the platen 230 to the lower guide member 216. The lower guide member 216 leads the polishing article 123 onto the take-up roll 252. The platen assembly 132 may also comprise an optical sensing device 220, such as a laser, adapted to transmit and receive optical signals for detecting an endpoint to the planarizing or polishing process performed on a substrate.

The polishing article 123 is generally moved in relation to the platen 230 by balancing the forces between a motor coupled to the supply assembly 206 and a motor coupled to the take-up assembly 208. An example of an advanceable web assembly is disclosed in FIGS. 2–8 of U.S. Pat. No. 6,503,131, issued Jan. 7, 2003, entitled "Integrated Platen Assembly for a Chemical Mechanical Planarization System", which is incorporated herein by reference. Alternative and optional drive systems are contemplated by this invention, some of which can be found in the description of FIGS. 3A–7 of U.S. Pat. No. 6,244,935, previously incorporated by reference, not inconsistent with this invention.

Polishing Articles

Figure 3A:
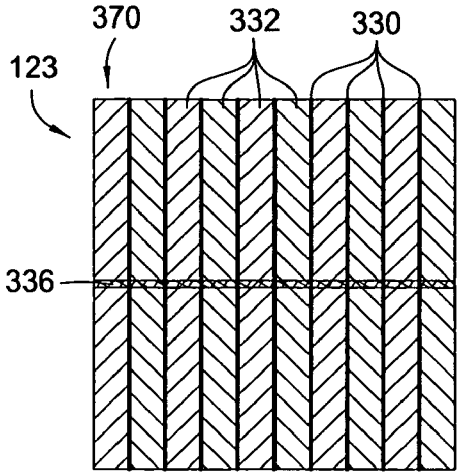
FIG. 3A is a top view of one embodiment of a polishing article assembly.
Figure 3B:
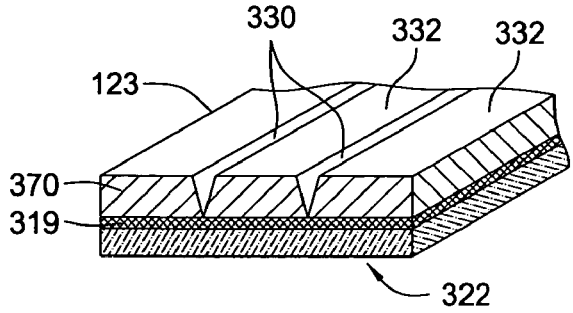
FIG. 3B is a partial isometric view of the embodiment shown in FIG. 3A.

FIGS. 3A and 3B depict one embodiment of a polishing article 123. The polishing surface of the polishing article 123 comprises a plurality of strips or tiles 332, separated by grooves 330 formed in or through a polishing material 370 adhered to a carrier film, such as a base film 322. Each of the plurality of strips or tiles 332 may be connected to another tile 332 by forming a groove 330 in the polishing material 370 to a depth that is less than the thickness of the polishing material 370, the depth of the groove selected to allow flexibility, while maintaining integrity, in the polishing material 370. Alternatively, the polishing material 370 may be cut therethrough by the grooves 330 to form a tile 332 that is separate or discrete, which is bound to the base film 322 by a suitable adhesive 319 that is chosen for resistance to chemical and physical elements used in CMP processes.

In the embodiment depicted in FIGS. 3A and 3B, the grooves 330 and the tiles 332 are substantially parallel to the cross-machine direction, i.e., transverse to the supply and take up roll direction. The grooves 330 form channels that may enhance slurry retention and delivery to the substrate surface. The grooves 330 are also used to break the surface tension of the polishing material 370, which is believed to add pliability to facilitate rolling of the polishing article 123 off a supply roll and onto a take up roll.

In the embodiment shown in FIG. 3A, the tiles 332 are substantially rectangular and are substantially the length of a cross-machine width of the base film 322. Other embodiments are contemplated, such as two substantially rectangular tiles 332 cut to a length substantially half of a cross-machine width of the base film 322, or the cross-machine width of the base film 322 divided by some integer, the tiles 332 cut to a length adapted to substantially span the cross-machine width of the base film 322. Alternatively, the tiles 332 may be cut to a length and positioned to leave a lateral, i.e., machine direction, portion 336 of the base film 322 exposed, which in this embodiment is transparent to light or electromagnetic radiation. As another alternative, the tiles 332 may be manufactured with a light or electromagnetic radiation transparent portion 336, and then adhered to the base film 322, which, in this embodiment, is also transparent to light or electromagnetic radiation emitted by an optical sensing device 220 (FIG. 2). The width, i.e., the dimension substantially perpendicular to the length, of the tiles 332 may be cut to any dimension. As one example, the tiles may have a width of about 1 inch.

Figure 4A:
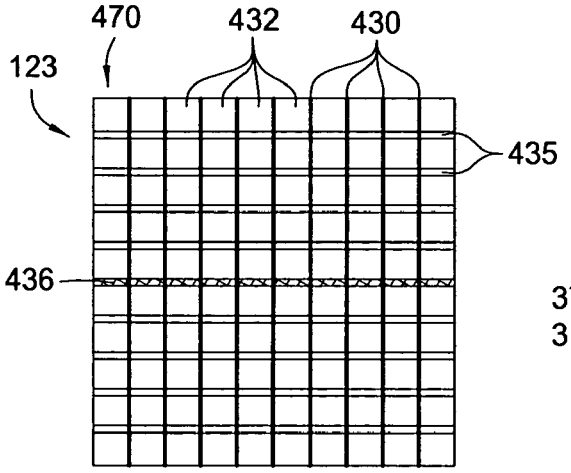
FIG. 4A is a top view of another embodiment of a polishing article assembly.
Figure 4B:
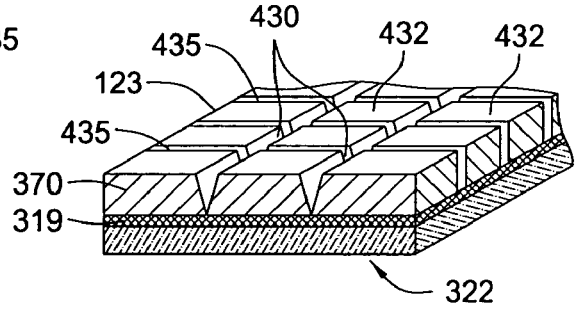
FIG. 4B is a partial isometric view of the embodiment shown in FIG. 4A.

FIGS. 4A and 4B depict another embodiment of the polishing article 123 comprising a plurality of strips or tiles 432 separated by adjacent transverse grooves 430 formed in or through a polishing material 370 and adhered to a base film 322. Each of the plurality of strips or tiles 432 may be connected to another tile 432 by forming a groove 430 in the polishing material 370 to a depth that is less than the thickness of the polishing material 370, the depth of the groove selected to allow flexibility, while maintaining integrity, in the polishing material 370. Alternatively, the polishing material 370 may exhibit a tensile strength and other mechanical attributes to facilitate movement in a roll format that obviates the need for the base film 322. In this embodiment, the plurality of tiles 432 may be formed by the plurality of grooves and used in a roll format without an adhesive 319 and the base film 322. As another alternative, the polishing material 370 may be cut therethrough by the grooves 430 to form a tile 432 that is separate or discrete which is bound to the base film 322 by a suitable adhesive 319 that is chosen for resistance to chemical and physical elements used in CMP processes. In the embodiment depicted, the polishing article 123 has corresponding lateral grooves 435, which are added to aid in slurry retention and delivery to the substrate, and to enhance flexibility of the polishing article 123.

The tiles 432 may be any shape and dimension to facilitate rolling off a supply roll and onto a take-up roll. The tiles 432 may be cut to a dimension and positioned to leave a lateral portion 436 of the base film 322 exposed, which in this embodiment is transparent to light or electromagnetic radiation. As another alternative, the tiles 432 may be manufactured with a light or electromagnetic radiation transparent portion 436, and then adhered to the base film 322, which, in this embodiment, is also transparent to light or electromagnetic radiation emitted by an optical sensing device 220 (FIG. 2). Still another alternative may be foregoing the placement of tiles 432 in a lateral portion 436 of the polishing article 123.

Figure 5A:
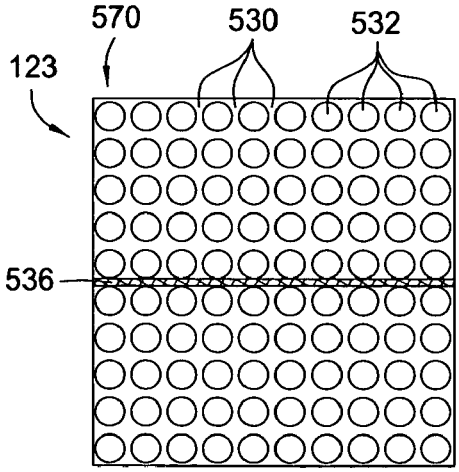
FIG. 5A is a top view of another embodiment of a polishing article assembly.
Figure 5B:
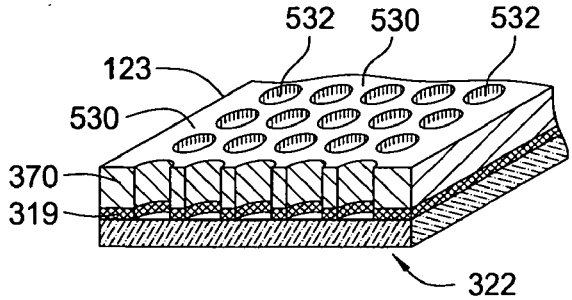
FIG. 5B is a partial isometric view of the embodiment shown in FIG. 5A.

FIGS. 5A and 5B depict another embodiment of a polishing article assembly 123, showing perforations 532 formed in the polishing material 370 and surrounded by the remaining polishing material 530. The polishing material 370 is bound to the base film 322 by a suitable adhesive 319 that is chosen for resistance to chemical and physical elements used in CMP processes. The perforations 532 in the polishing article 123 are substantially oval shapes, but may comprise other annular geometric shapes, such as a cone or hollow frustum i.e., a cone between substantially parallel planes, spaced to enhance slurry retention and aid in rolling of the polishing article 123. As in other embodiments, a lateral portion 536 of a transparent base film 322 may be exposed to allow an optical sensing device 220 (FIG. 2) access to the substrate 122. As another alternative, the remaining polishing material 530 may be manufactured with a transparent lateral portion 536, and then adhered to the base film 322, which, in this embodiment, is also transparent to light or electromagnetic radiation emitted by the optical sensing device 220.

Figure 6A:
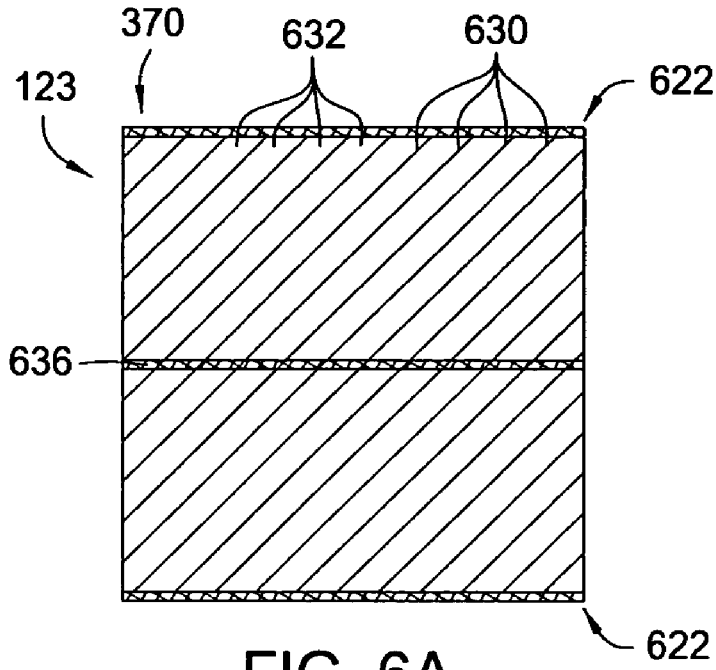
FIG. 6A is a top view of another embodiment of a polishing article assembly.
Figure 6B:
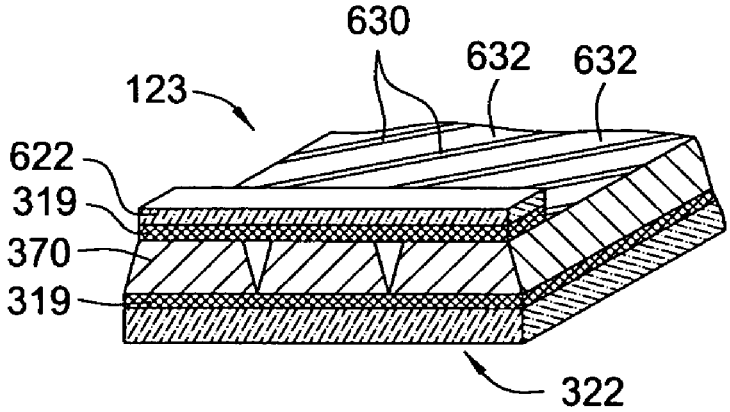
FIG. 6B is a partial isometric view of the embodiment shown in FIG. 4A.

FIGS. 6A and 6B depict another embodiment of a polishing article 123. The polishing surface of the polishing article 123 comprises a plurality of oblique tiles 632 separated by oblique grooves 630 formed in or through a polishing material 370 adhered to a base film 322. Each of the plurality of oblique tiles 632 may be connected to another tile 632 by forming an oblique groove 630 in the polishing material 370 that is less than the thickness of the polishing material 370. Alternatively, the polishing material 370 may exhibit a tensile strength and other mechanical attributes to facilitate movement in a roll format that obviates the need for the base film 322. In this embodiment, the plurality of tiles 632 may be formed by the plurality of grooves and used in a roll format without an adhesive 319 and the base film 322. As another alternative, the polishing material 370 may be cut therethrough by the grooves 630 to form a tile 632 that is separate or discrete. The polishing material 370, with the oblique groove 630 formed therein, or the discrete oblique tile 632, is bound to the base film 322 by a suitable adhesive 319 that is resistant to chemical and physical elements used in CMP processes. The oblique grooves 630 form channels that may enhance slurry retention and delivery to the substrate surface. The oblique grooves 630 are also used to break the surface tension of the polishing material 370, which is believed to add pliability to facilitate rolling of the polishing article 123 off a supply or feed roll and onto a take up roll.

As in other embodiments, a lateral portion 636 of a transparent base film 322 may be exposed to allow an optical sensing device 220 (FIG. 2) access to the substrate 122. As another alternative, the polishing material 370 may be manufactured with a transparent portion 636, and then adhered to the base film 322, which, in this embodiment, is also transparent to light or electromagnetic radiation emitted by the optical sensing device 220.

Also shown is an upper film 622 adhered to the upper side of the oblique tiles 632. The upper film 622 is bound by a suitable adhesive 319 as narrow strips on opposing machine direction edges of the polishing article 123, i.e., each machine direction edge of the polishing article 123, preferably in an area of the polishing article 123 that is not employed for polishing. The upper film 622 is adapted to counteract stress and delaminating influences that may be encountered by the oblique tiles 632 as the polishing article 123 is advanced over small radius bends from the supply roll 254 to the take up roll 252 on either end of the platen assembly 132. (See FIG. 2). It is also contemplated that the positioning of the oblique tiles 632 may limit the delaminating forces and thereby preventing the oblique tiles 632 from lifting or separating from the base film 322. It is also contemplated that the upper film 622 may be used in the embodiments depicted in FIGS. 3A, 3B, 5A, and 5B to counteract the delaminating forces and prevent the tiles 332 or remaining polishing material 530 from lifting or separating from the base film 322.

The oblique tiles 632 may be adhered to the base film 322 in a position that is substantially parallel to the cross machine direction, e.g., 0 degrees, (similar to FIGS. 3A and 3B) or the diagonal tiles 632 may be adhered to the base in a cross machine direction greater than 0 degrees to about 50 degrees, for example, 45 degrees from a position substantially parallel to the cross machine direction. As in other embodiments, the oblique tiles 632 may be cut or positioned to maintain a lateral portion 636 in the polishing article 123. Alternatively, the oblique tiles 632 may be manufactured with a lateral portion 636 that is transparent to light or electromagnetic radiation.

In the above embodiments of the polishing article 123, the base film 322 is a plastic material, such as a Mylar® film, that is chosen for flexibility and durability and is of a thickness between about 0.002 inches (50.8 μm) to about 0.012 inches (304.8 μm), for example, about 0.004 inches (101.6 μm). The polishing material 370 is a polymeric material with a hardness in a range of about 20–80 on the Shore D scale, and has an average surface roughness 0.5 μm to about 12 μm dimensioned in a range between about 0.016 inches (406.4 μm) to about 0.060 inches (1,524 μm), for example, about 0.040 inches (1,016 μm). In a one embodiment, the thickness of the polishing article 123 is between about 0.019 inches (482.6 μm) to about 0.060 inches (1,524 μm). It is contemplated that the voids or perforations 532 may be added in combination with the tiles 332, 432, 632 on the polishing article 123. It is further contemplated that the polishing material 370 may form the polishing article 123 without the use of a base film. In this embodiment, the polishing material may exhibit a tensile strength and other mechanical attributes that obviate the use of the base film. The plurality of grooves may be formed in the polishing material to a depth that is less than the thickness of the polishing material to connect the plurality of tiles, thereby forming a polishing article 123 without a base film capable of use in a roll format.

Figure 7:
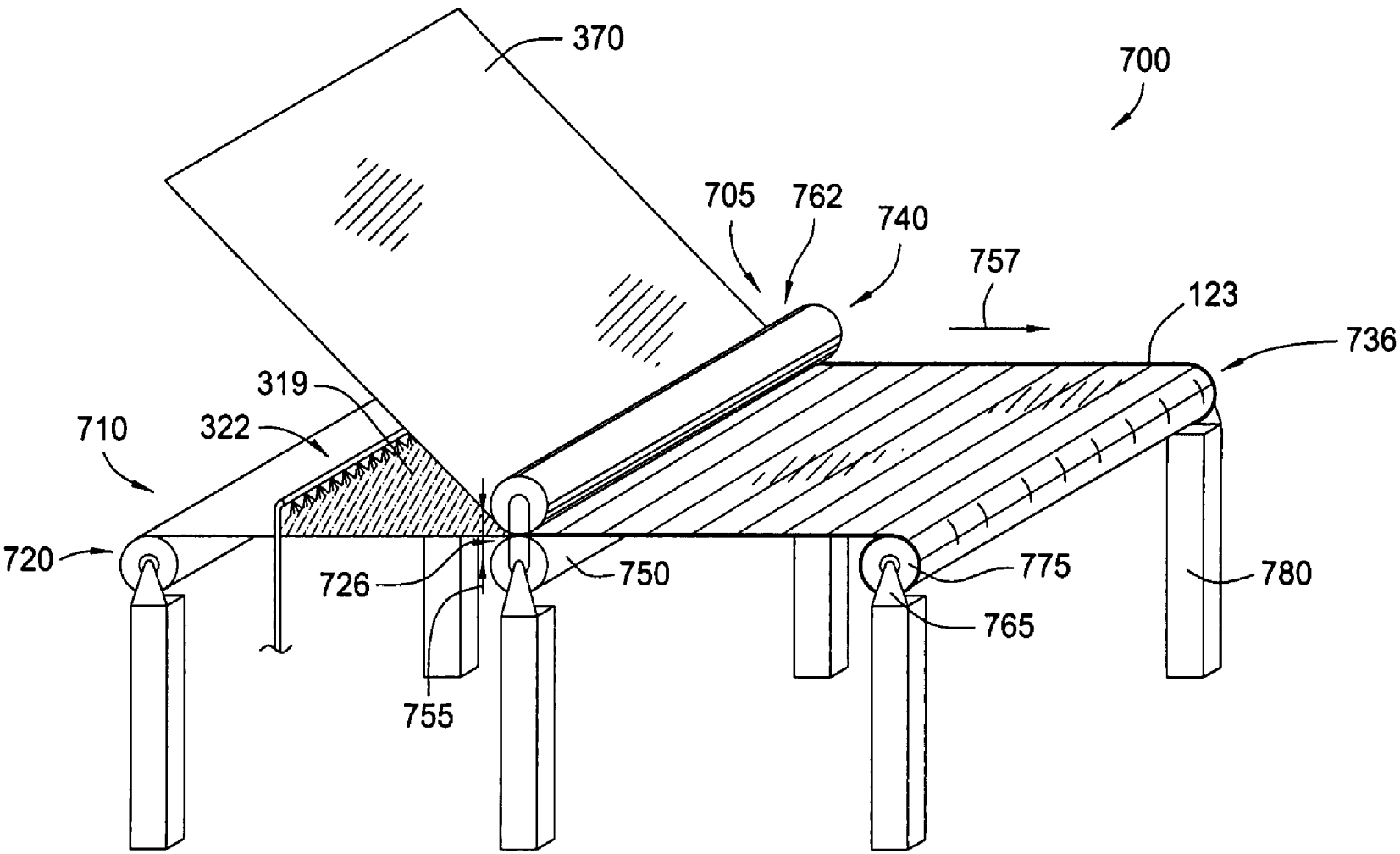
FIG. 7 is an isometric view of an exemplary supply cartridge assembly apparatus.

FIG. 7 depicts a cartridge assembly apparatus 700 suitable for manufacturing a polishing cartridge 736. The apparatus comprises a carrier film or base supply roll 720, a pinch roller assembly 705 that comprises an upper pinch roller 740, a lower pinch roller 750, and a roller drive assembly 762. It is contemplated that the apparatus 700 may operate to fill a polishing cartridge 736 with a polishing article 123 capable of use as a replacement supply cartridge 254 for a supply roll 254.

In operation, an empty dowel 775 or used center of a supply roll 254 is attached by appropriate fasteners to the assembly table 710 and the drive assembly 765. A carrier film or base film 322 is supplied from the base supply roll 720 and provided to the gap 726 between the upper pinch roller 740 and lower pinch roller 750 with a layer of adhesive 319 applied from an adhesive spray bar. The adhesive 319 may be a temperature and/or pressure sensitive adhesive that is compatible with the process chemistries of a CMP system. Polishing material 370 is then provided by suitable conveyance to the gap 726 and the pinch rollers 740, 750 are forced together in the direction of arrow 755 which operate to join the base film 322 and the polishing material 370 therebetween. The polishing article 123 is then linearly pushed across the table 710 by roller drive assembly 762 in the direction of arrow 757.

It is contemplated that the polishing material 370 may be delivered to the gap 726 in a continuous roll or in discrete strips or tiles 332, 432, 632 of various dimensions and lined up sequentially prior to entering the gap 726 for subsequent attachment to the base film 322. It is also contemplated that the polishing material 370 may be supplied with perforations 532 (FIG. 5) for joining to the base film 322. In the case of discrete sequential strips or rectangles of the polishing material 370, the placement prior to attachment will be configured to produce a grooved pattern on the polishing article 123 that will be similar to the embodiments of the polishing article 123 seen in FIGS. 3A–4B, 6A, and 6B. Alternatively, a second pinch roller assembly may be used upstream or downstream of the pinch roller assembly 705 and configured to form discrete strips or tiles 332, 432, 632 and perforations 532 in the polishing material 370 prior to joining with the base film 322. In this alternative, the second pinch roller assembly will be adapted to cut, punch or perforate the polishing material 370. In another alternative, the pinch roller assembly 705, or the second pinch roller assembly, may be adapted to punch, perforate, or cut the polishing material 370 to a depth that does not separate the polishing material into discrete strips or tiles 332, 432, 632, thereby forming the channels or grooves 330, 430, 630.

A supply roll similar to supply roll 720 may be added to the apparatus 700 to supply the upper film 622 to the gap 726, with a suitable adhesive applicator positioned upstream to bind the upper film 622 to the polishing material 370. In this manner, all of the various layers may be joined into one unitary piece to form the embodiment depicted in FIGS. 6A and 6B.

After suitable pressure is supplied to the pinch roller assembly 705, the polishing article 123 is wound or rolled by suitable conveyance onto the dowel 775. Once the dowel 775 is filled to a suitable diameter of the polishing article 123, the polishing article 123 is severed adjacent the dowel 775 and the replacement polishing cartridge 736 may be removed and placed into service on the platen assembly 132 as a supply roll 254. At this time, an empty dowel 775 may be affixed to the assembly table 710 and the process may start again.

While the foregoing is directed to embodiments of the present invention, other and further embodiments of the invention may be devised without departing from the basic scope thereof, and the scope thereof is determined by the claims that follow.

The invention claimed is:

1. A processing article for removing material from a substrate, comprising:

a linear base film;

an adhesive layer; and a plurality of polishing tiles positioned on the adhesive layer across a width of the base film and configured to define a plurality of grooves therebetween, wherein the plurality of grooves enable fluid flow therein and facilitate delivery and take up in a roll format.

2. The processing article of claim 1, further comprising an upper film bound on the plurality of tiles.

3. The processing article of claim 1, wherein each of the plurality of tiles are substantially rectangular.

4. The processing article of claim 1, wherein the plurality of tiles define a polishing surface with a lateral portion in the polishing surface that is transparent to light or electromagnetic radiation.

5. The processing article of claim 1, wherein the plurality of tiles supported on the base film are configured for use on a web type platen assembly.

6. The processing article of claim 1, wherein the polishing tiles have an average surface roughness of about 0.5 micrometers to about 12 micrometers.

7. The processing article of claim 1, wherein the polishing tiles have a hardness of about 20 to about 80 on the Shore D hardness scale.

8. The processing article of claim 1, wherein each of the plurality of tiles are discrete from each other.

9. A processing article for removing material from a substrate, comprising:

a linear base film;

a plurality of polishing tiles comprising a polishing material positioned on the base film and configured to define a plurality of grooves therebetween, wherein the plurality of grooves are formed through the polishing material and are configured to enable fluid flow therein and facilitate delivery and take up in a roll format.

10. The processing article of claim 9, further comprising an upper film bound on the plurality of tiles.

11. The processing article of claim 9, wherein each of the plurality of tiles are substantially rectangular.

12. The processing article of claim 11, wherein the substantially rectangular tiles substantially covers a width of the base film.

13. The processing article of claim 9, wherein the plurality of tiles define a polishing surface with a lateral portion that is transparent to light or electromagnetic radiation.

14. The processing article of claim 9, wherein the plurality of tiles supported on the base film is configured for use on a web type platen assembly.

15. The processing article of claim 9, wherein the polishing tiles have an average surface roughness of about 0.5 micrometers to about 12 micrometers.

16. The processing article of claim 9, wherein the polishing tiles have a hardness of about 20 to about 80 on the Shore D hardness scale.

17. The processing article of claim 9, wherein each of the plurality of tiles are discrete from each other.

* * * * *